United States Patent [19]

Knopp

[11] 4,138,184

[45] Feb. 6, 1979

[54] TERMINATING MEANS FOR A MULTI-WIRE CABLE

[75] Inventor: Chauncey D. Knopp, Middletown, Pa.

[73] Assignee: AMP Incorporated, Harrisburg, Pa.

[21] Appl. No.: 883,564

[22] Filed: Mar. 6, 1978

[51] Int. Cl.[2] ..... H01R 13/38

[52] U.S. Cl. ..... 339/97 P

[58] Field of Search ..... 339/19, 97 R, 97 P, 339/98, 99 R

[56] References Cited

U.S. PATENT DOCUMENTS

| | | | |
|---|---|---|---|
| 3,958,853 | 5/1976 | Wilson | 339/99 R |
| 4,040,703 | 8/1977 | Shaffer et al. | 339/99 R |
| 4,040,704 | 8/1977 | Huber | 339/99 R |
| 4,085,994 | 4/1978 | Volinskie | 339/97 R |

*Primary Examiner*—Joseph H. McGlynn

*Attorney, Agent, or Firm*—AMP Incorporated

[57] ABSTRACT

A connector means for terminating a ribbon-type cable consisting either of plurality of single conductors or a plurality of coaxial cables and comprising a connector housing having a flat main body portion with at least one partially closed channel formed on each side thereof and oppositely positioned with respect to each other. A contact means has its first end retained within each of the partially closed channel portions and its second ends extending outwardly therefrom and comprising a plate-like element extending away from the flat main housing body and having a slot formed therein which opens onto that edge of the plate-like elements which is farthest from the flat main housing body. A wire from the ribbon cable is placed over the slot in each slotted plate-like terminal. A pair of wing-like elements are pivotally connected to the partially closed single channels and constructed to pivot toward each other and over the plate-like elements of the contacts and thereby force the wires into the slots. Simultaneously, the extreme ends of the wing-like elements come together around the cable above the flat main housing body of the connector to grip the cable and thereby provide strain relief therefor. The wing-like elements and the main housing body are provided with locking elements which lock the wing-like elements in their closed and upright position.

12 Claims, 14 Drawing Figures

TERMINATING MEANS FOR A MULTI-WIRE CABLE

BACKGROUND OF THE INVENTION

This invention relates generally to a connector means for terminating a multi-wire cable of the ribbon type which can be of the ribbon type containing either a plurality of single conductors or a plurality of coaxial cables and more specifically it relates to an improved connector which can be applied to a multi-wire cable in a one step assembly operation with a strain relief function for the cable being an inherent structural feature of the connector and effective during the assembly of the connector upon the cable.

A common problem in the electrical art today is the termination of a multi-wire cable such as a multi-wire flat ribbon cable composed of individual conductors or a ribbon cable including a plurality of individual coaxial cables positioned side-by-side in parallel arrangement. One of the more frequent terminating requirements is to provide a connector which terminates the individual conductors of the cable and also provides means, such as female receptacles, for receiving terminal posts or other external connections, which are thereby connected to the individual wires of the cable through the connector contacts.

One prior art connector means for terminating such multi-wire cables comprised a housing having a main portion consisting of a substantially flat center portion with a plurality of parallel channels formed on either side thereof and which are constructed individually to receive the first end of a contact such as a terminal post. The other ends of the contacts extend upwardly toward the upper end of the center portion of the housings and terminate in a suitable means for securement to individual wires of the multi-wire cable. Such securing means can be a crimping means, for example.

In the assembly of the connector to the ribbon cable, selected wires of the cable, alternate ones, for example, are first crimped in the contacts on one side of the flat center portion of the housing by an appropriate crimping tool such as a press. The connector must then be turned over and the remaining wires crimped in the contacts on the other side of said center portion of the housing. Thus, two individual steps are required to crimp the wires in the contacts, one each for the two sides of the housing body. Subsequently, strain relief means, which usually consist of two matable pieces, are fitted at one end thereof over the connector and at the other end thereof around the undressed portion of the coaxial ribbon cable. The two halves of the strained relief structure are secured together in their mated position by suitable fastening means such as screws or bolts.

Thus, the complete assembly of the prior art connector involves at least four distinct steps including the dressing of the cable, the crimping of the wires into the contact on one side of the main housing body, crimping the wires into the contacts on the other side of the main housing body, and then securing the two halves of the anti-strain structure together around both the main connector housing body and the ribbon cable.

BRIEF STATEMENT OF THE INVENTION

It is a primary object of the invention to provide a connector for terminating the stripped ends of the wires of a ribbon cable in a single operation which includes a strain relief means and which can be easily applied in the field.

It is a second purpose of the invention to provide a connector for terminating the stripped wires of a ribbon cable in which the connector is an integral structure comprising means for terminating the wires of the cable and also for providing cable strain relief structure in a single assembly operation in which the connector is applied to the cable.

It is a third aim of the invention to provide a single piece connector for terminating the wires of the ribbon cable which wires can be either single wire conductors or coaxial cable and for providing a strain relief for said ribbon cable all in a single assembly step.

It is a further object of the invention to provide an improvement generally in means for terminating ribbon cables either of the type having a plurality of single wires or a plurality of coaxial cables.

In accordance with one preferred embodiment of the invention there is provided a housing having a generally flat main body portion with at least one partially closed channel formed on opposite sides thereof and with the portion of each channel having an open side facing outwardly from the main body portion and further having wing-like portions which are pivotally connected to the ends of the channels and which are positioned to pivot on pivotal connections to close towards one another over the open sides of the channels and thereby secure within the channels the said contact means which have been positioned therein.

The said contact means have a first end which is retained within the closed portion of the channel and is constructed to receive another external contact means, such as a terminal post. The contact means comprises a second end which extends along the open portion of the channel and which has an open side constructed to receive individual ones of the conductors of the flat ribbon cable. More specifically the second ends of the contacts consist of one or more plate-like elements extending away from the open side of the flat body portion and having wire receiving slots formed therein which open at that edge of the plate-like elements farthest from the main housing body. At least one of such slots has a width which is narrower than the diameter of the conductor portion of the wire to be inserted therein in order to make electrical and mechanical connection with the wire when it is pushed into said slot. The winged portion of the housing comprises ribs or pushers formed on the surface thereof which become positioned along side the plate-like elements to push the wire into said slots in the plate-like elements when the wing-like elements are closed towards one another over the open sides of the channels and which are secured to the main housing body by appropriate locking means.

In their closed position pivoted against the main housing body the ends of said wing-like elements extend beyond the end of said main housing body to grip the nonstripped portion of the ribbon cable therebetween and thus provide strain relief therefor.

In accordance with a feature of the invention the closing of the wings over the wires installed in the slots of the slotted terminals simultaneously functions to force the wires deep into the slots of the terminals, to grip the undressed portion of the ribbon cable to provide a strain relief therefor, and to become locked together in such closed position.

BRIEF DESCRIPTION OF THE DRAWINGS

The above-mentioned and other objects and feature of the invention will become more fully understood from the following detailed description thereof when read in conjunction with the drawings in which.

DETAILED DESCRIPTION OF THE INVENTION

Figure 1:
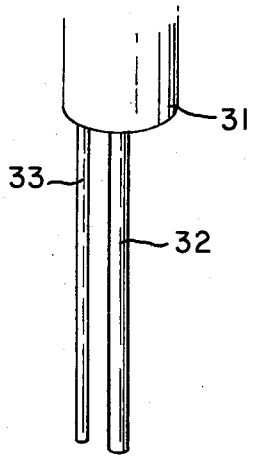
FIG. 1 is a perspective view of a form of the invention constructed to receive a two wire cable, such as a coaxial cable, with the wings of the connector in their open position and with the dressed end of the cable poised above the connector preparatory to assembly.
Figure 4A:
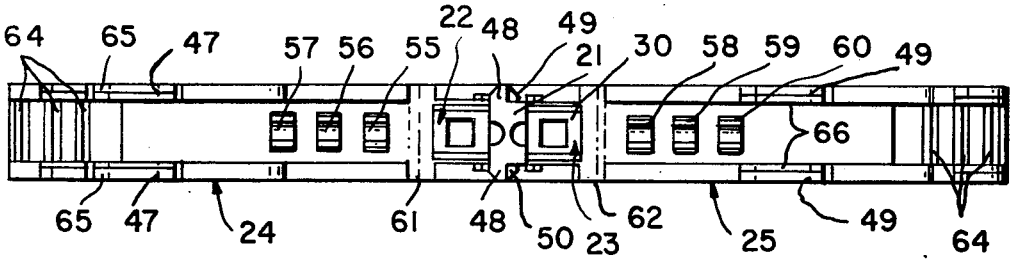
FIG. 4A is a side view of the structure of FIG. 1.
Figure 4:
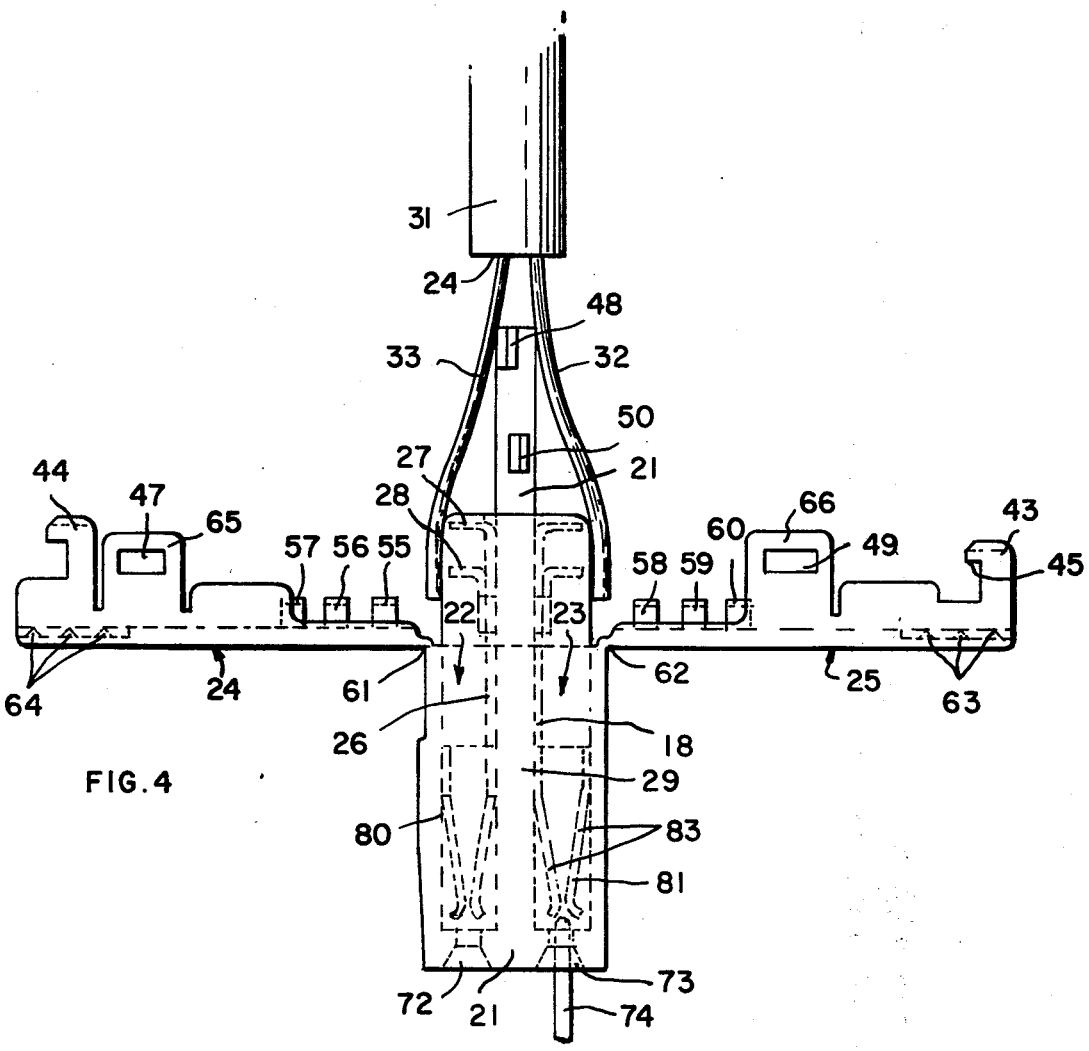
FIG. 4 is a top plan view of the structure of FIG. 1.

Referring to FIG. 1 the connector 20 has a main housing body portion 21 with a channel 22 formed on one side thereof and a channel 23 formed on the other side thereof, which can better be seen in FIG. 4. A contact, such as contact 26, is retained within each of the channels 22 and 23 with the upper portions thereof extending out of said channels and along the surface 19 of housing portion 21. The portion of the contacts extending out of channel 22 comprises a pair of plates 27 and 28 extending outwardly from the bed surface 19 of the housing body portion 21. Each of the plate-like elements 27 and 28 has a slot, such as slots 29 and 30, formed therein and opening onto that edge of the plate extending away from the bed surface 19 of housing body portion 21.

Wire 33 of two wire cable 31 fits into the two slots 29 and 30 of the contact 26 on one side of body portion 21 and the other wire 32 of cable 31 fits in the slots of the contacts (not visible in FIG. 1) of the contacts on the other side of flat body housing portion 21.

Figure 3:
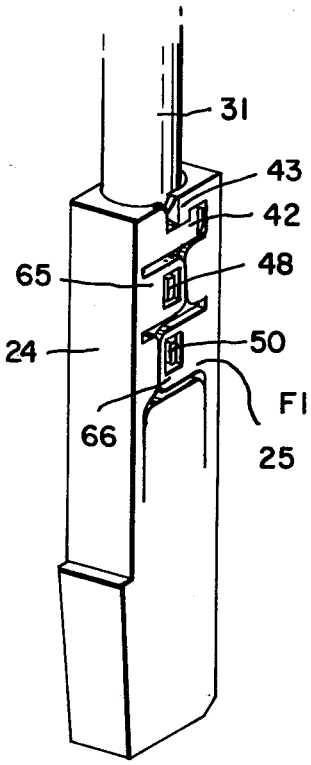
FIG. 3 is a perspective view of the assembled connecter after the two wing-like elements have been closed upon the two wires of the cable.

The wing-like elements 24 and 25 are secured to the main body portion 21 of connector 20 by flexible connecting means 61 and 62 so that said wing-like elements 24 and 25 can pivot upwardly and together over the exposed housing body portion 21 in the manner shown in FIG. 3. The pusher elements 55 and 56, of which two are shown on the wing-like element 24 FIG. 1, move to a position immediately on either side of the two plate-like elements 27 and 28 as the wing-like element 24 is pivoted upward into its upright position, to push the wire 33 into the slots 29 and 30.

With the wing-like element 24 in its upright position the apertures 47 in the tabs 65 snap over the protuberances 48 on the main housing body 21 and the apertures 49 in the tabs 66 snap over the protuberances 50 on main housing body portion 21, as shown more clearly in FIG. 3.

The shoulders 46 on the pawl-like elements 42 mate with the shoulders 45 on pawl-like elements 43 on wing-like element 25, also as shown in FIG. 3.

The teeth like elements 64 formed in the end of wing 24 along with similar teeth formed in the wing 25 grip the plastic sheathing of cable 31 when the wing-like elements 24 and 25 are closed together in their upright position, as shown in FIG. 3.

Figure 2:
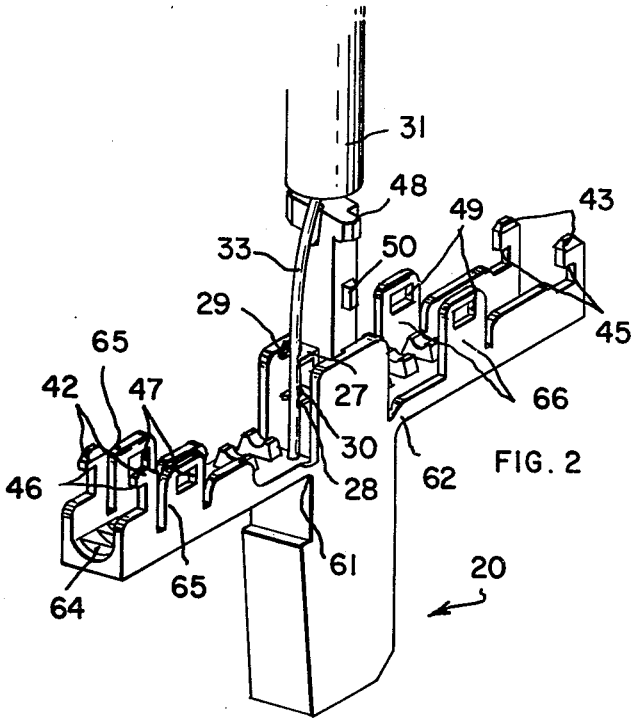
FIG. 2 is a perspective view of the structure of FIG. 1 but with the two wires of the coaxial cable in position in the slots in the connectors contacts just before closing of the two wing-like elements of the connector.

In FIG. 2 there is shown the structure of FIG. 1 but with the wires 33 and 32 of cable 31 positioned over the entrance to the contact slots such as slots 29 and 30 of plate-like elements 27 and 28. The remaining structural elements of FIG. 2 are identified by the same reference characters identifying corresponding elements in FIG. 1.

In FIG. 3 the connector is shown in its completely assembled form with the two wings 24 and 25 pivoted upwards and together around cable 31. The interlocking pawls 43 and 42 are shown in their interlocked condition. Further, the protuberances 48 and 50 are shown mated with the apertures in locking elements 65 and 66.

Figure 4B:
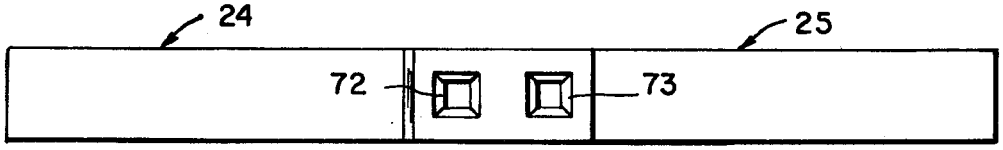
FIG. 4B is a bottom view of a structure of FIG. 1.

Referring now to FIG. 4 through 4B there are shown plan views of the connector housing of FIGS. 1 through 3. Specifically in FIG. 4 the side view of the housing is shown with the wing portions 24 and 25 in their open position and extending from the main body portion 21 of the connector housing to which they are attached by flexible hinging means 61 and 62. It is to be noted that non-integral, interlocking pivotal means can be employed in lieu of flexible hinging means. The two wire cable 31 is shown poised above the connector with the two wires 33 and 32 positioned over the slots in the plate-like elements such as elements 27 and 28 of contact 26 preparatory to being pushed therein by the wings 24 and 25 when said wing-like elements are pivoted to their upright position in the manner shown in FIG. 3.

The lower ends 80 and 81 of contacts 26 and 18 are shown positioned in the channels 22 and 23. Such lower ends 80 and 81 are formed into suitable means such as a pair of spring contacts for receiving terminal posts. More specifically the lower end 81 of contact 18 has a pair of contact springs 83 which can receive a terminal post 74 therein. The employment of a pair of springs 83 to receive a post 74 is simply one of several possible configurations at the lower end of contacts 26 and 18. Alternatively such lower ends 80 and 81 of contacts 26 and 18 could themselves be terminal posts or they could extend outwardly from apertures 72 and 73 at the bottom of housing 21 as solder lugs or other type terminating or connecting means appropriate for various external terminal or connecting means.

Figure 5A:
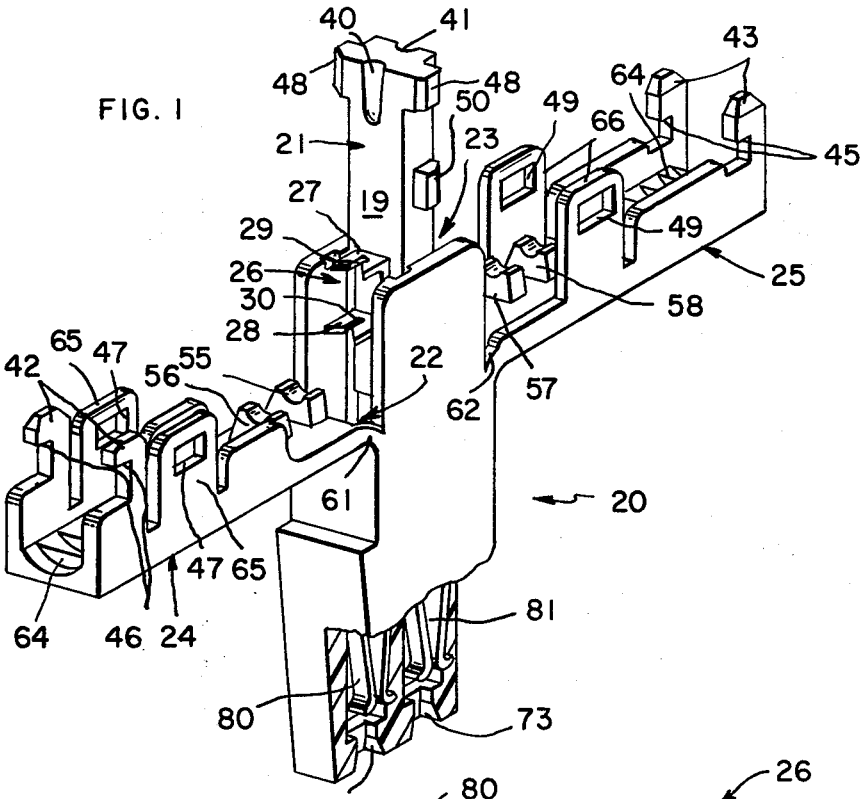
FIG. 5A is a top view of a contact of FIG. 5.
Figure 5A:
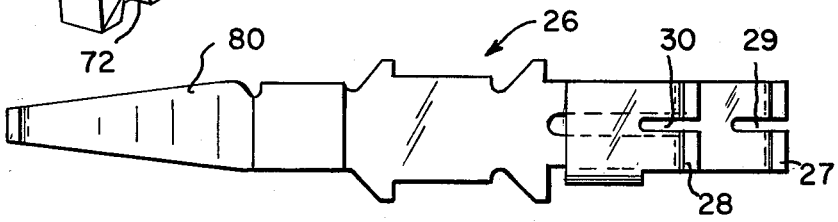
Figure 5:
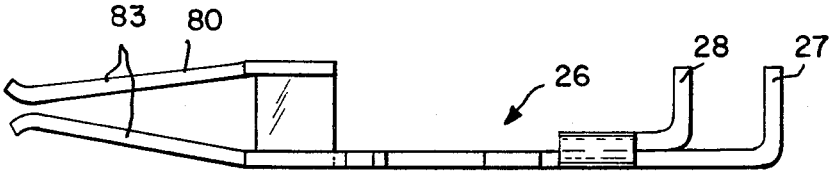
FIG. 5 is a side view of a form of the contact employable in the connector.

The contact 26 is shown more clearly in FIGS. 5 and 5A with parts thereof identified by the same reference characters identifying corresponding parts in FIGS. 1 through 3. Similarly, the various parts of the structure of FIGS. 4 through 4B are identified by the same reference characters which identify corresponding parts in the structure of FIGS. 1 through 3.

FIG. 4A shows a top view of FIG. 4 and more clearly shows the relationship of the various element such as the pushers 55 through 60 and the ribs 64 with respect to each other and with respect to the main body portion 21 of the connector. The contacts 26 and 18 which are shown in FIG. 4 are not shown in FIGS. 4A or 4B.

FIG. 4B is a bottom view of a structure of FIG. 4 and shows in more detail the configuration of the apertures 72 and 73 of the structure of FIG. 4.

Figure 6:
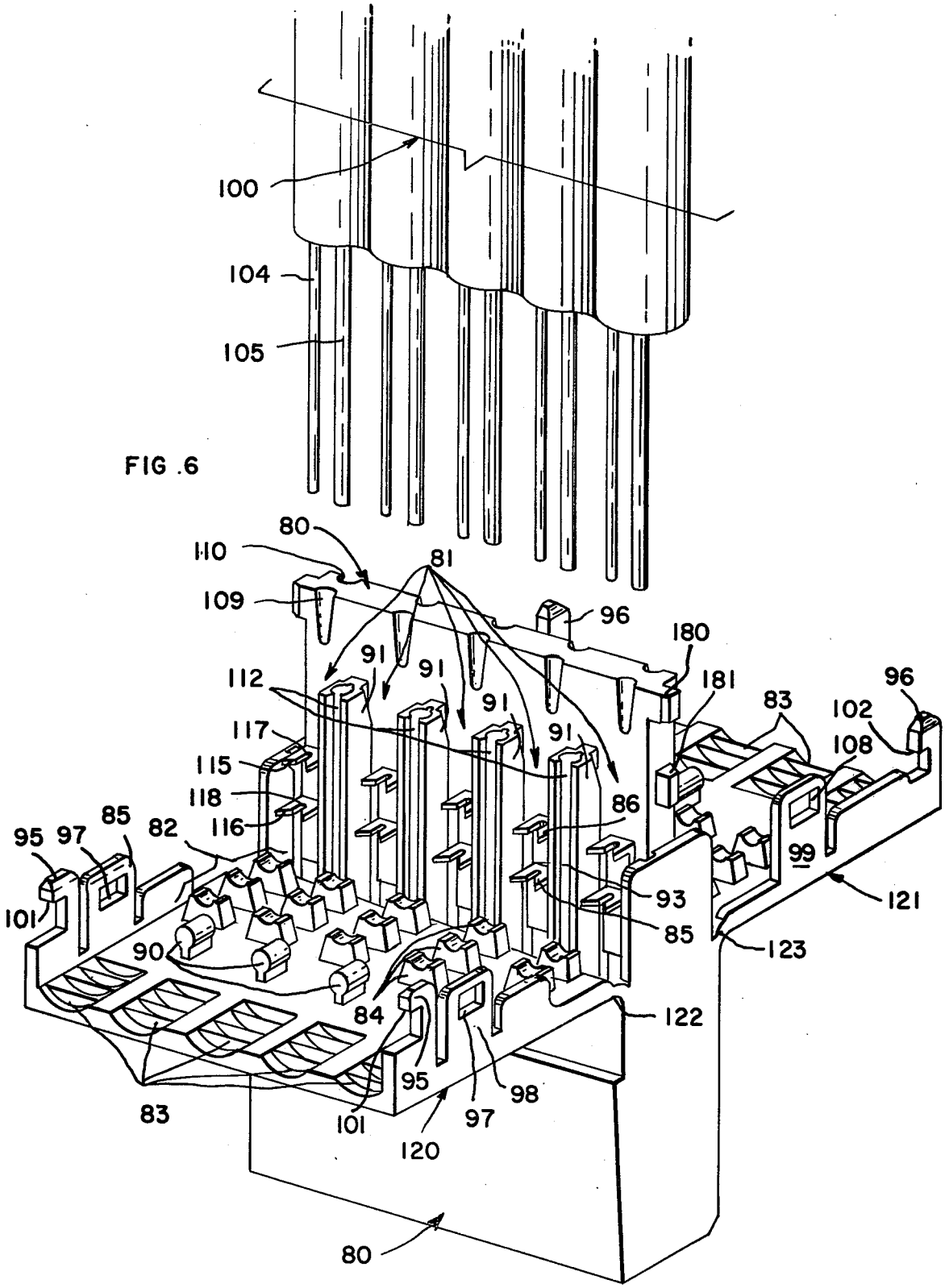
FIG. 6 is a perspective view of a form of the invention constructed to terminate a multi-wire ribbon cable with the wing-like elements of the connector being open and with the dressed end of the cable to be terminated poised above the connector prior to assembly.

Referring now to FIG. 6 there is shown an embodiment of the invention constructed to receive a plurality of pairs of conductors which can be in the form of two wire coaxial cables or a plurality of single conductors contained in a flat ribbon cable. In FIG. 6 five coaxial cables are shown collectively by reference character 100, each cable comprising a pair of conductors as, for example, drain wire 104 and center conductor 105.

The ribbon cable 100 is poised above the connector which is comprised of a flat base portion 80 having a plurality of channels on either side thereof. For example, on the side visible in FIG. 6 there are shown five channels 81 which are separated by grooved elements 91 with the grooves therein being designated by reference character 112.

In each of the five channels 81, which are separated by the grooved elements 91, there is positioned a contact similar to the contact shown in the structure of FIGS. 5 and 5A. Each of said contacts has a pair of flat, plate-like elements such as elements 115 and 116 shown in the left hand contact of FIG. 6. Slots 117 and 118 are formed in these two plate-like elements 115 and 116 to receive one of the wires 104 or 105. In the particular configuration of FIG. 6 slots 117 and 118 are constructed to receive the conductor 104. A similar contact positioned oppositely on the other side of the main body portion 80 is constructed to receive the other wire 105 of the coaxial cable.

Figure 8:
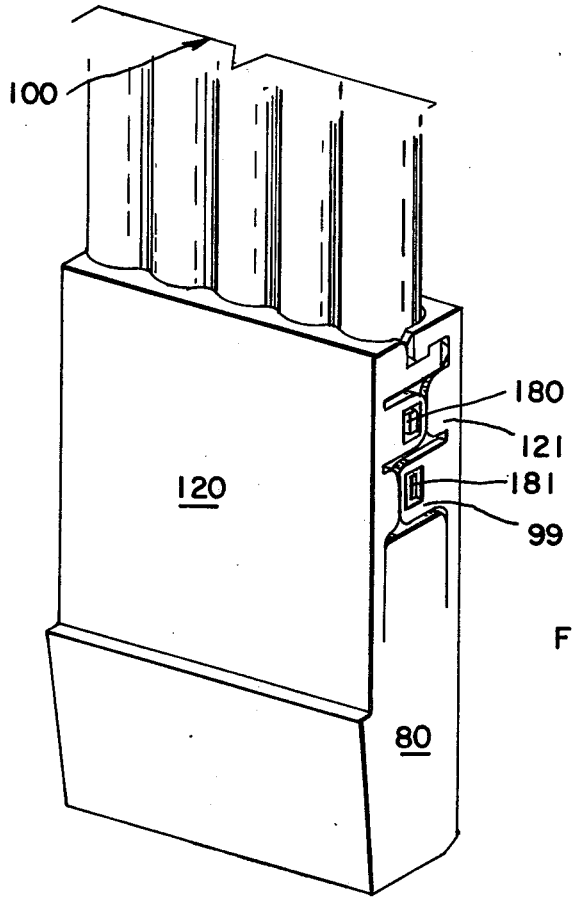
FIG. 8 is a perspective view of the connector of FIG. 6 in its assembled state.

Once the wires of the coaxial cables 100 are positioned over the slots of the contacts in which they are to be inserted the wing-like elements 120 and 121 are pivoted upward around their flexible hinges 122 and 123 to form the assembled configuration shown in FIG. 8.

The cylindrically shaped locking elements 90 function to snap into the grooves 112 of grooved elements 91 to retain the wing-like element 120 firmly fixed against the main body portion 80 of the connector housing. The pushers designated generally by reference character 82 function in the same manner as the pushers 55 through 60 of FIG. 1 to push the wires, such as wires 104 and 105, into slots 117 and 118 of the various contacts positioned in the channels 81 of the connector.

Further, in a manner similar to that described in connection with FIGS. 1 through 3, the pawl-like elements 95 on wing-like element 120 interlock with the pawl-like element 96 on wing-like element 121 so that the shoulders 101 and 102 of pawl-like elements 95 and 96 snap over one another. Also, the apertures 97 and 108 in elements 98 and 99 snap over the protuberances 180 and 181 formed on the side of main housing body 80. It is to be further noted that wires, such as wires 104 and 105, are partially positioned by the grooves 109 and 110 formed near the top of the main body portion 80 of the connector housing.

Figure 7:
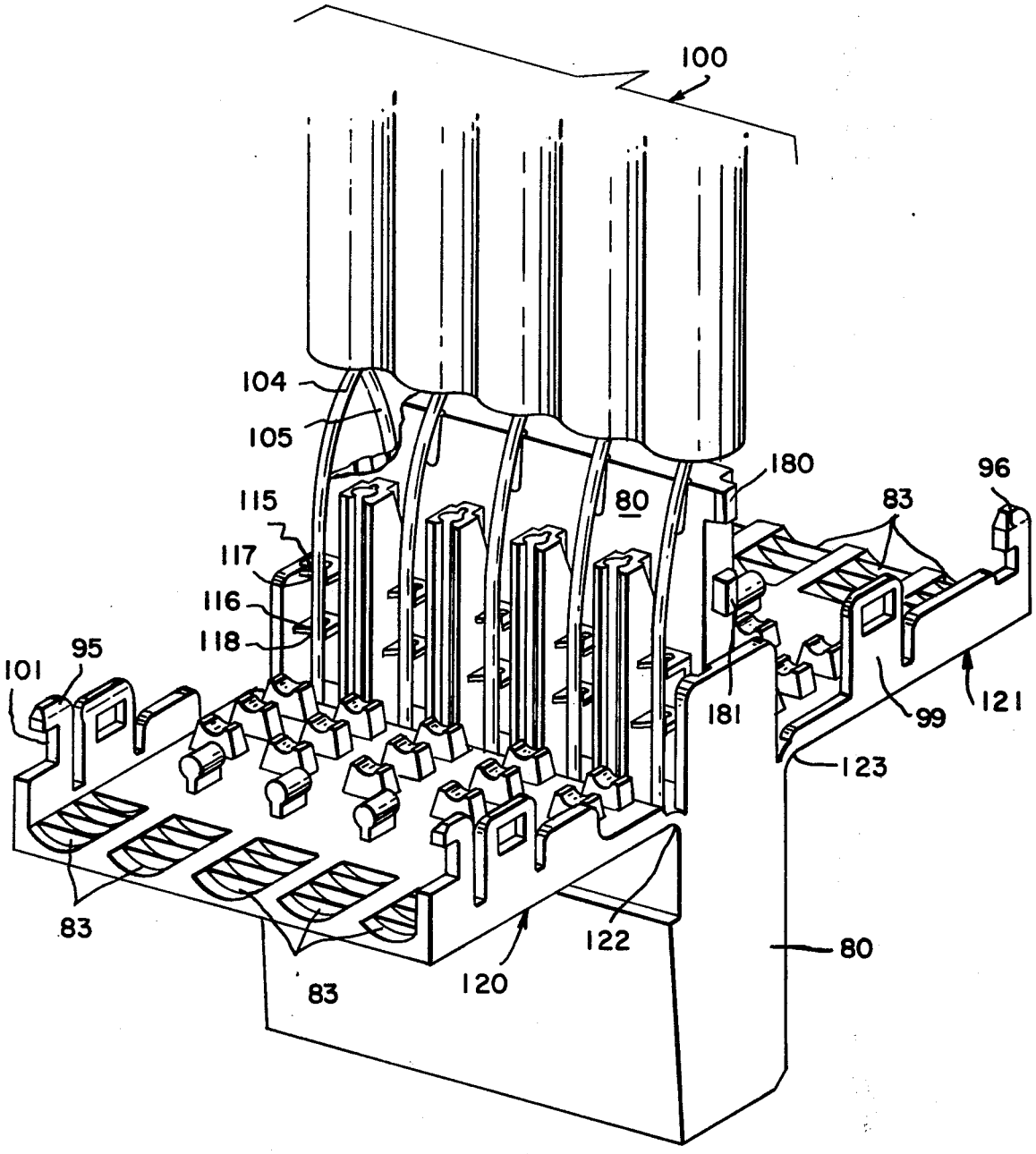
FIG. 7 is a perspective view of the structure of FIG. 6 with the wires positioned in the slotted terminals prior to closing the wing-like elements of the connector housing.

The structure of FIG. 6 is shown in FIG. 7 with the individual wires such as the ground 104 and the signal wire 105 of each of the coaxial cables positioned over the slots such as slots 117 and 118 of the plate-like elements 115 and 116 preparatory to the wing-like elements 120 and 121 being pivoted upwardly about their flexible hinges 122 and 123 to mate together around the sheathed portion of the ribbon-like cable 100, as shown in FIG. 8.

Figure 9:
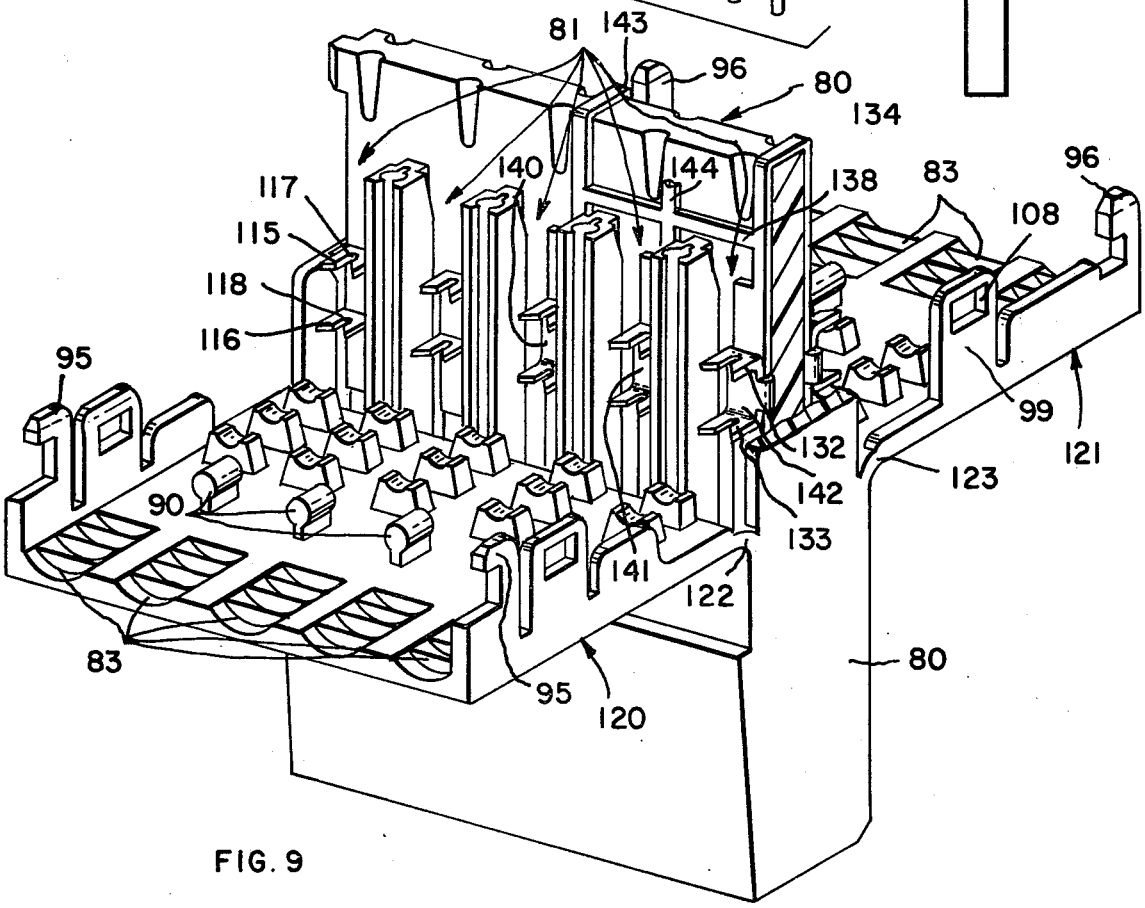
FIG. 9 is a perspective view showing the termination of a cable having a plurality of single conductors and with programmable ground connections for selected signal positions.

FIG. 9 shows an adaptation of the connector to receive a ribbon-like cable comprised of a number of individual conductors 160. By appropriate design the conductors can be terminated in a GSGGSGGSG configuration, where G is ground and S is signal. Specifically such GSGGSGGSG connections can be effected by a double slotted plate-like element such as shown in FIG. 11 which can be employed in lieu of the single slotted plate-like elements 115 and 116 of FIG. 9.

Figure 11:
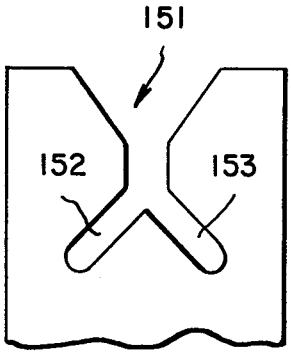
FIG. 11 shows a slotted terminal having two slots formed therein to retain two wires.

In the double slotted terminal as shown in FIG. 11 the two ground wires can be simultaneously inserted into the slot entrance 151. One of the two wires will enter the slot 152 and the other wire will enter the second slot 153. A more detailed description of the structure and function and operation of the double slotted terminal is disclosed in co-pending application Ser. No. 820,504 filed Aug. 1, 1977 by Edward Armond Bianchi et al and entitled Coaxial Cable Connector.

In another form of the invention selected ones of the contact means such as contacts 140, 141, and 142 on one side of the flat housing portion 80 can be connected together by a conductive element 138 to form a common bus which, if desired, can be at ground potential. Further selected ones of the contacts such as contacts 140 and 142 on one side of the housing portion 80 can be connected in a programmable manner to contacts on the other side not visible in FIG. 9 of the flat housing portion 80 by means of conductive strips 134 and 143.

Figure 10:
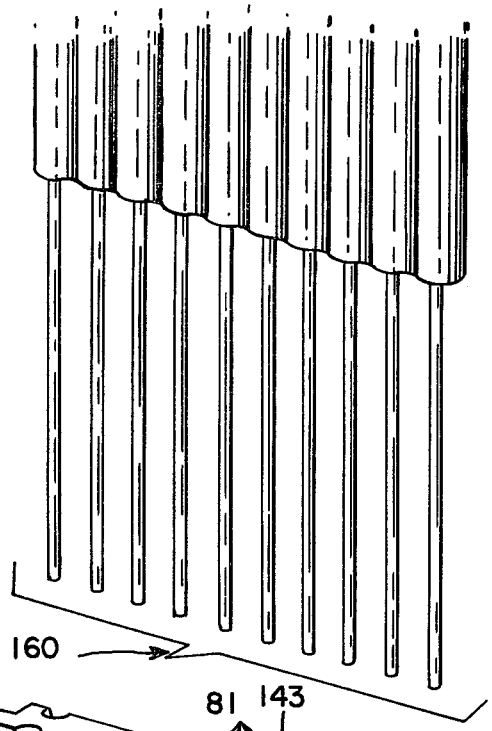
FIG. 10 shows a blank stamping for the contacts employable in the connector of FIG. 9.
Figure 10:
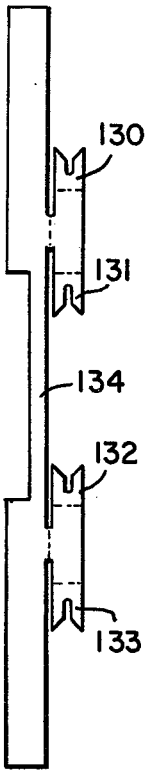

The metal blank to form the connected pairs of contacts on opposite sides of the flat housing portion 80 is shown in FIG. 10. Plate-like elements 132 and 133 are connected to plate-like elements 130 and 131 which are positioned on the non-visible side of housing 80 by the conductive strip 134. Such conductive strip 134 can be severed as is strip 144 if it is desired to electrically separate the plate-like elements 130 and 131 from plate-like elements 132 and 133.

It is to be noted that the embodiments of the invention are shown and described herein are but preferred embodiments thereof and that various changes can be made in the configuration of the various parts thereof, including both the housing and the contacts, without departing from the spirit or scope of the invention.

What is claimed is:

1. A connector for terminating at least a pair of wires extending from a cable and comprising a housing and contact retained in said housing;

said housing comprising:

a first housing portion having first and second surfaces formed on opposite sides thereof; and first and second channel-like contact retaining means formed on and extending along a first portion of each of said flat surfaces;

said contact means each having first and second ends and each comprising at said first end thereof a first means for connecting to an external conductive element and at the second end thereof a second means for connecting to one of said wires;

said second means comprising a plate-like element extending away from said first surface of said housing portion and having a slot means formed thereon which opens onto an edge of said plate-like element which is positioned away from said first housing portion;

said housing further comprising;

hinge-like members;

first and second wing-like elements each comprising third surfaces and attached to said first and second contact retaining means by said hinge-like members;

said wing-like members further constructed to pivot about said hinge-like members to close upon each other with said third surfaces facing each other to grip the cable therebetween;

said wing-like elements further each comprising pusher elements formed on said third surfaces and which become positioned adjacent said plate-like elements when the wing-like elements are in their closed position to push said wires into said slot means in said plate-like elements; and means for maintaining said wing-like elements in their closed positions.

2. A connector as in claim 1 in which the slot means formed in said plate-like elements comprise:

a single entrance slot; and first and second slots which extend from said single entrance slot into the plate-like element towards said first housing portion;

each of said first and second slots constructed to receive one of two wires forced into said single entrance slot.

3. A connector as in claim 1 comprising a conductive element which connects selected ones of said contact means on one side of said first housing portion to contact means on the other side of said first housing portion.

4. A connector as in claim 1 comprising conductive means which connects together selected contact means on one side of said flat housing portion.

5. A connector for terminating at least a pair of wires extending from a cable and comprising:

a housing comprising;

a generally flat portion having first and second surfaces formed on opposite sides thereof; and first and second contact retaining means formed on each of said first and second surfaces;

contact means each comprising;

a first end which is retained in one of said contact retaining means; and a second end thereof constructed to connect to one of said wires;

said second end comprising a plate-like element extending away from said generally flat housing portion and having a slot formed therein which opens onto that edge of said plate-like element which is positioned generally away from said flat housing portion;

said housing further comprising;

connecting means;

first and second wing-like elements attached to said first and second contact retaining means by said connecting means;

said wing-like members further constructed to pivot about said connecting means to close upon each other to grip wires of the cable therebetween;

said wing-like elements further each comprising pusher elements formed thereon which become positioned adjacent said plate-like elements when the wing-like elements are in their closed position to push said wires into said slots in said plate-like elements; and means for locking said wing-like elements in their closed positions.

6. A connector as in claim 5 in which the slots formed in said plate-like elements comprise:

a single entrance slot; and first and second slots which extend from said single entrance slot into the plate-like element towards said generally flat housing portion;

each of said first and second slots constructed to receive one of two wires forced into said single entrance slot.

7. A connector as in claim 5 comprising a conductive element which connects selected ones of said contact means on one side of said flat housing portion to contact means on the other side of said generally flat housing portion.

8. A connector as in claim 5 comprising conductive means which connects together selected contact means on one side of said generally flat housing portion.

9. A connector for terminating a plurality of wires and comprising:

a first housing portion having first and second substantially flat surfaces formed on opposite sides thereof;

a plurality of contact retaining means on said oppositely positioned flat surfaces with each contact retaining means being positioned opposite another contact retaining means located on the oppositely positioned flat surface;

contact means each comprising:

a first end thereof retained in one of said contact retaining means; and a second end thereof connectable to one of said wires;

said second end comprising plate-like means extending away from said first surface of said housing portion and having a slot formed therein which extends out of said plate-like means at an edge thereof which is positioned away from said first housing portion;

first and second connecting elements;

a plurality of wing-like elements having first surfaces formed thereon and individually attached to one of said contact retaining means by one of said connecting elements;

said wing-like members further constructed to pivot about said connecting elements to close upon each other with said first surfaces facing each other to grip the cable therebetween;

said wing-like elements further each comprising pusher elements formed on said first surfaces which pusher elements become positioned on either side of said plate-like means when the wing-like elements are in their closed position to push said wires into said slots in said plate-like means; and means for locking said wing-like elements in their closed positions.

10. A connector as in claim 9 in which the slots formed in said plate-like means comprise:

a single entrance slot; and first and second slots which extend from said single entrance slot into the plate-like means towards said first housing portion;

each of said first and second slots constructed to receive one of two wires forced into said single entrance slot.

11. A connector as in claim 9 comprising a conductive element which connects selected ones of said contact means on one side of said first housing portion to contact means on the other side of said first housing portion.

12. A connector as in claim 9 comprising conductive means which connects together selected contact means on one side of said flat housing portion.

* * * * *